US011820538B2

(12) United States Patent
Farkas et al.

(10) Patent No.: US 11,820,538 B2
(45) Date of Patent: Nov. 21, 2023

(54) HOLE PUNCHING AND SPINDLE STUFFING AFTER BAGGER

(71) Applicant: GPCP IP Holdings LLC, Atlanta, GA (US)

(72) Inventors: Scott B. Farkas, Fremont, WI (US); Austin T. Ketterhagen, De Pere, WI (US); Guy W. Wolff, Neenah, WI (US); Abby C. Case, Green Bay, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 107 days.

(21) Appl. No.: 17/485,618

(22) Filed: Sep. 27, 2021

(65) Prior Publication Data

US 2022/0097882 A1 Mar. 31, 2022

Related U.S. Application Data

(60) Provisional application No. 63/084,599, filed on Sep. 29, 2020.

(51) Int. Cl.

| | |
|---|---|
| ***B65B 25/14*** | (2006.01) |
| ***B65B 61/00*** | (2006.01) |
| ***B65B 61/20*** | (2006.01) |
| ***B65B 57/00*** | (2006.01) |
| ***B65B 61/18*** | (2006.01) |
| ***B65D 85/672*** | (2006.01) |
| ***B65D 85/671*** | (2006.01) |

(Continued)

(52) U.S. Cl.

CPC ..... *B65B 25/146* (2013.01); *B65B 5/00* (2013.01); *B65B 61/005* (2013.01); *B65B 61/18* (2013.01); *B65B 61/20* (2013.01); *B65D 85/671* (2013.01); *B65D 85/672* (2013.01); *B65C 2009/407* (2013.01); *B65D 2203/02* (2013.01)

(58) Field of Classification Search

CPC ..... B65B 25/14; B65B 25/141; B65B 25/145; B65B 25/146; B65B 61/005; B65B 61/18; B65B 61/20; B65B 2220/14; B65D 85/671; B65D 85/672; B65C 1/02; B65C 2009/407; A47K 10/40; A47K 2010/3206

USPC ..... 53/415, 445, 468, 474, 50, 136.1, 136.3, 53/136.5, 154, 155, 238; 206/225, 226, 206/391

See application file for complete search history.

(56) References Cited

U.S. PATENT DOCUMENTS

| | | | | |
|---|---|---|---|---|
| 2,322,175 A * | 6/1943 | Talbot et al. | ..... | B65B 61/20 53/50 |
| 2,345,190 A | 3/1944 | Freund | | |
| 2,395,176 A | 2/1946 | Eilersgaard | | |

(Continued)

FOREIGN PATENT DOCUMENTS

| | | | | |
|---|---|---|---|---|
| GB | 2380178 A * | 4/2003 | ..... | B65D 85/672 |
| JP | 02191127 A * | 7/1990 | | |

*Primary Examiner* — Stephen F. Gerrity

(57) ABSTRACT

Embodiments are directed to methods, systems and packages for packaging the coreless paper products and accessory products. Embodiments include receiving paper products, receiving a container used for packaging the paper products, and packaging the paper products into the container. Embodiments also include inserting accessory products into a cavity formed by the paper products packaged in the container, and applying a label on the container to cover the cavity where the accessory products are inserted.

18 Claims, 4 Drawing Sheets

(51) Int. Cl.
*B65B 5/00* (2006.01)
*B65C 9/40* (2006.01)

(56) References Cited

U.S. PATENT DOCUMENTS 2,628,713 A 2/1953 Diederich
2,678,129 A 5/1954 Spector
3,670,473 A * 6/1972 Bobb ..... B65D 85/64 53/50
3,770,118 A 11/1973 Jones
3,915,301 A 10/1975 Gray et al.
3,926,425 A * 12/1975 Pierce ..... B65B 61/20 156/443
5,163,725 A 11/1992 Leweallyn
5,186,099 A * 2/1993 Qing et al. ..... B65B 63/02 53/438
6,227,360 B1 5/2001 Kessler
7,048,225 B2 * 5/2006 Delfino ..... A47K 10/40 206/391
7,383,953 B2 * 6/2008 Dickinson ..... B65D 85/00 53/474
7,428,966 B2 9/2008 Goodall et al.
7,559,434 B2 7/2009 Masting
7,650,993 B2 1/2010 Bawabe
7,743,919 B2 * 6/2010 Maeda et al. ..... B65D 85/672 206/391
8,584,892 B2 11/2013 Lira
9,056,693 B2 * 6/2015 Lattanzi et al. ..... B65B 61/207
9,227,281 B1 * 1/2016 Meadows ..... A47K 10/16
10,233,012 B2 * 3/2019 Wentz et al. ..... B65D 85/671
10,544,006 B2 * 1/2020 Forrest et al. ..... B65D 85/672
10,583,974 B2 * 3/2020 Hokanson et al. .. B65D 71/066
2007/0277707 A1 * 12/2007 Robbins et al. ..... B65D 85/671 206/386
2009/0057169 A1 * 3/2009 Kruchoski et al. .... A47K 10/40 206/225
2013/0299622 A1 11/2013 Trainer, Jr. et al.
2016/0137398 A1 * 5/2016 Lemke et al. ..... B65D 85/671 206/391
2018/0215486 A1 * 8/2018 Franzaroli ..... B65B 25/146
2020/0002071 A1 * 1/2020 Anklam et al. ..... B65B 25/146
2020/0216247 A1 * 7/2020 Barran et al. ..... B65D 75/5838
2023/0002100 A1 * 1/2023 Beckers et al. ..... B65C 1/02

* cited by examiner

HOLE PUNCHING AND SPINDLE STUFFING AFTER BAGGER

CROSS REFERENCE TO RELATED APPLICATION

This application is based on U.S. Provisional Patent Application No. 63/084,599, filed Sep. 29, 2020, which is hereby incorporated by reference in its entirety.

BACKGROUND

The present invention relates in general to tissue and paper fabrication methods and resulting devices. More specifically, the present invention relates to a package, a system, and a method for packaging coreless tissue products and accessory products by hole punching and accessory product stuffing after the bagger.

Tissue and paper sheets for household use are well known in the art. Rolled paper products, such as bath tissue, are generally provided in one of two forms, coreless rolls or cored rolls. Cored rolls are commonly used for residential and light commercial use and include a supporting tube located in the center aperture of the roll with the tissue product wrapped around the supporting tube. Coreless rolls are commonly used in commercial buildings and generally include tissue wound very densely around a small center aperture.

Current coreless tissue products have typically been manufactured with center apertures that are considerably smaller in diameter compared to the center aperture of traditional cored products, which increases capacity and minimizes the occurrence of crushing of the center aperture. Further, traditional commercial coreless tissue products are not sized for use with dispensers designed for traditional cored roll tissue products.

SUMMARY

According to one embodiment of the present invention, a method for packaging the coreless paper products and the accessory products is provided. Embodiments of the method include receiving paper products, receiving a container used for packaging the paper products, and packaging the paper products into the container. Embodiments of the method can also include inserting an accessory product into a cavity formed by the paper products packaged in the container, and applying a label on the container to cover the cavity where the accessory product is inserted.

According to another embodiment of the present invention, a system for packaging the coreless paper products and the accessory products is provided. Embodiments of the system can include a bagger for receiving a container and paper products, wherein the bagger is configured to package the paper products into the container, and a cavity formed by the paper products in the container, wherein the cavity is adapted to receive an accessory product. Embodiments of the system can also include a labeler for applying a label on the container to cover the cavity where the accessory product is inserted.

According to another embodiment of the present invention, a package including the coreless paper products and accessory products is provided. Embodiments of the package include a plurality of paper products forming a cavity, and a container that packages the plurality of paper products, wherein the container includes an opening, wherein the opening is aligned over the cavity formed by the plurality of paper products. Embodiments of the package can also include one or more accessory products that have been inserted into the cavity, wherein the cavity houses the accessory products, and a label that is applied to the opening that is aligned over the cavity formed by the plurality of paper products.

BRIEF DESCRIPTION OF THE DRAWINGS

The subject matter of the present invention is particularly pointed out and distinctly defined in the claims at the conclusion of the specification. The foregoing and other features and advantages are apparent from the following detailed description taken in conjunction with the accompanying drawings in which:

DETAILED DESCRIPTION

Figure 1:
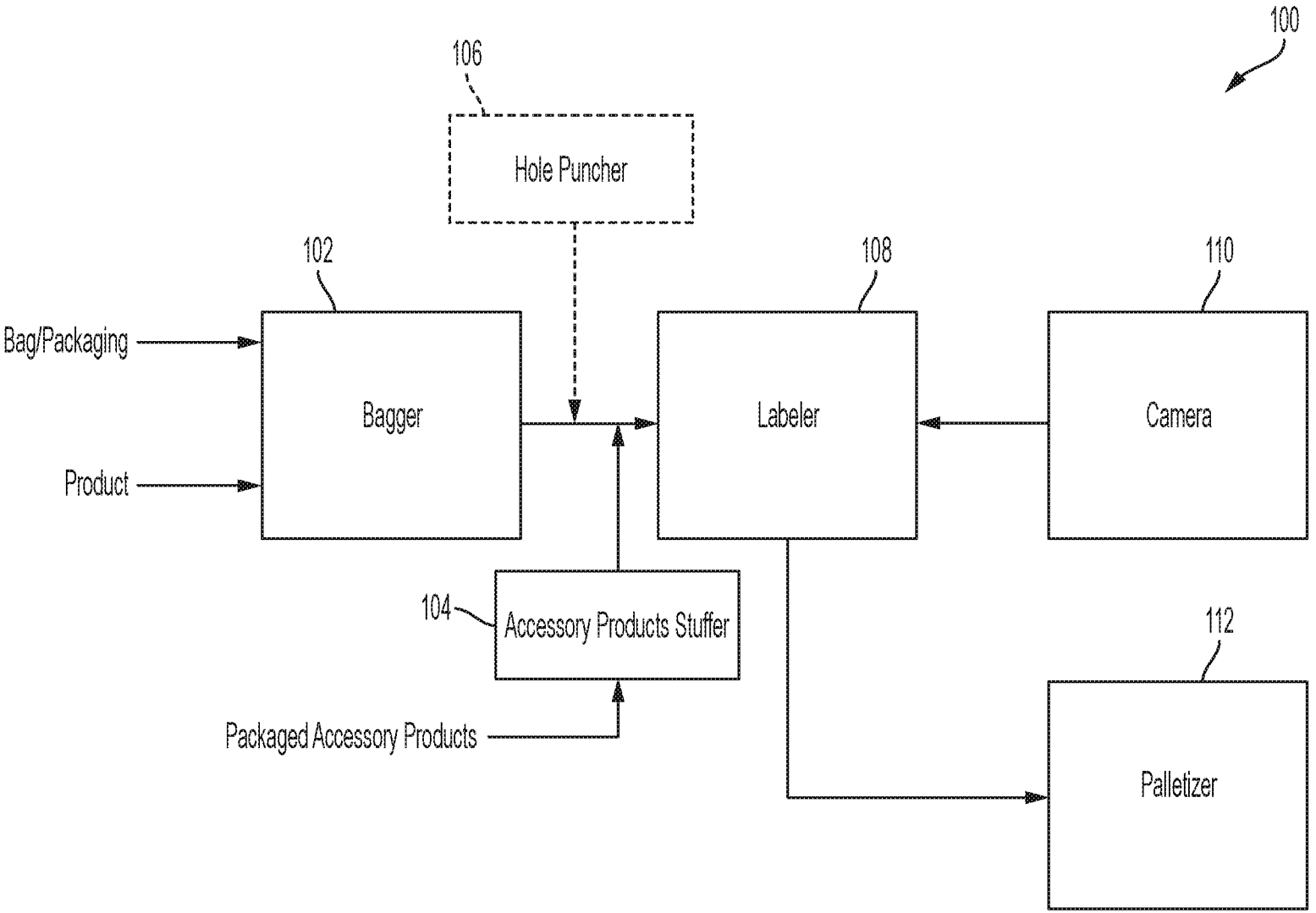
FIG. 1 is a block diagram illustrating a system used for packaging coreless roll products and accessory products in accordance with one or more embodiments of the present invention.

Various embodiments of the present invention are described herein with reference to the related drawings. Alternative embodiments can be devised without departing from the scope of this invention. It is noted that various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection."

References in the specification to "one embodiment," "an embodiment," "an example embodiment," etc., indicate that the embodiment described can include a particular feature, structure, or characteristic, but every embodiment may or may not include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

For purposes of the description hereinafter, the terms "upper," "lower," "right," "left," "vertical," "horizontal," "top," "bottom," and derivatives thereof shall relate to the disclosed structures and methods, as oriented in the drawing figures. The terms "overlying," "atop," "on top," "positioned on" or "positioned atop" mean that a first element, such as a first structure, is present on a second element, such as a second structure, wherein intervening elements such as an interface structure can be present between the first element and the second element. The term "direct contact" means that a first element, such as a first structure, and a second element, such as a second structure, is connected without any intermediary elements at the interface of the two elements.

As used herein, a "unit" is defined as that portion of the sheet that is discrete as delivered to the consumer. For example, this would include, but not be limited to, a single table napkin, a single roll of paper toweling, a single facial tissue, or a single roll of bath tissue.

As used herein, the terms "about," "substantially," "approximately," and variations thereof are intended to include the degree of error associated with measurement of the particular quantity based upon the equipment available at the time of filing the application. For example, "about" can include a range of ±8% or 5%, or 2% of a given value.

As used herein, "continuous" means a relatively long product produced in a mostly continuous manufacturing process. An example of a continuous product for use in the present process or apparatus is a rolled sheet where the length of the sheet on the roll is very long in relation to its width.

For the sake of brevity, conventional techniques related to tissue paper packaging may or may not be described in detail herein. Moreover, the various tasks and process steps described herein can be incorporated into a more comprehensive procedure or process having additional steps or functionality not described in detail herein. In particular, various steps employed in the packaging of tissue paper are well known and so, in the interest of brevity, many conventional steps will only be mentioned briefly herein or will be omitted entirely without providing the well-known process details.

In embodiments, methods and systems are provided for packaging coreless roll products and accessory products. As used herein, the term coreless roll product refers to a rolled paper product that has a center aperture which does not include a supporting tube in the center aperture. In some embodiments, the center aperture can range from approximately one-half inch to four inches in diameter, or about 10 to 100 millimeters. The coreless roll products can include a wide variety of paper products such as bath tissue, paper towels, napkins, thermal paper, or the like. Also, as used herein, the term accessory products can include spindle adapters that are used to accommodate the coreless roll products. Additionally, the accessory products can include but are not limited to coupons or advertisements, sample products such as air fresheners, new tissue products, or sanitizing products, or other types of supplemental products.

As previously noted herein, household tissue and paper sheets are often provided in various counts and sizes. One disadvantage of using large rolls is that additional adapters may be required if the housing is not designed to hold such large rolls. In some cases, additional spindle adapters may be available for purchase. In other cases, customers may completely replace their tissue paper holders to accommodate larger rolls of product.

There are disadvantages associated with the conventional use of large coreless rolls. Customers would be burdened with purchasing an additional spindle adapter to use their recently purchased paper products. In addition, manufacturers would be required to provide an additional package and SKU. This can increase the cost and complexity of producing the products. Also, in the event, the spindle adapters are not available at the point of purchase customers may have to locate spindle adapters at a different location prior to using the large rolls. Thus, an improved packaged product including the required spindle adapters is desired.

One or more embodiments of the present disclosure relate to methods, systems, and structures for improved packaging of coreless tissue rolls and accessory products. A tissue product and associated packaging methods in accordance with embodiments of the present invention are described in detail below by referring to the accompanying drawings in FIGS. 1-4.

Referring now to FIG. 1 a block diagram illustrating a system for packaging the paper products and the accessory products in accordance with one or more embodiments is provided. The paper products that are packaged in this non-limiting example includes coreless tissue rolls. The system 100 can include a bagger 102 that is used to package the paper products. Although, paper products are described it should be understood that products can include any type of rolled product such as tissue rolls, label rolls, ink rolls, etc. The coreless tissue rolls can be packaged in a variety of arrangements and sizes. In one or more embodiments, the paper product can be packaged in 12 count and/or 24 count retail bundles.

In one or more embodiments, the bagger 102 receives a bag that has been previously punctured with an opening to receive the spindle adapters later in the packaging process. In a different embodiment, the bag can be punctured after the paper products have been placed into the bag/container. It should be understood that other types of overwrap material can be used to retain the packaged materials.

The bagger 102 receives the bags and the product. As the paper product is placed into the bag, the pre-punctured opening is aligned with a hollow region formed between the multiple paper products such as the coreless tissue rolls. By aligning the opening in the bag with the hollow region a cavity is formed by the coreless tissue rolls that can be used to house the accessory products. In a non-limiting example, the accessory products can include spindle adapters.

The system 100 can include an accessory product stuffer such as the spindle stuffer 104 that is configured to insert accessory products and spindle adapters, respectively, into the packaging. In one or more embodiments, the accessory products or spindle adapters are inserted into the packaging through the opening in the bag that has been aligned with the cavity formed between the multiple coreless paper products during the bagging process.

In one or more embodiments, the accessory products are packaged in their respective packaging prior to being inserted into the package. In a non-limiting example, multiple spindle adapters can be packaged in a single spindle adapter package prior to being inserted into the packaging or wrap including the coreless tissue rolls. By pre-packaging the spindle adapters into a spindle adapter package, it is easier to insert the multiple spindle adapters into the packaging. It should be understood that multiple accessory products of a different type can be packaged in a separate package prior to being inserted into the packaging including the coreless paper products. In one or more embodiments, a plurality of spindle adapters is inserted into the packaged product through a hole in a side of the package. The spindle adapter package can include a plastic, paper, wrap, or the like.

In some embodiments, when the received bags are not pre-punctured with openings for the accessory products, a hole puncher 106 can be used to puncture the bag over the cavity region formed by the coreless tissue rolls to form an opening to insert the accessory products. The size of the openings can vary but is limited by the cavity formed by the coreless tissue rolls and the size of the accessory products. After the hole puncher 106 punctures the opening in the bag, the spindle stuffer 104 inserts the spindle adapters into package and the products proceed to a label applicator 108.

The system 100 includes a label applicator 108 which is used to place a label over the hole in the package. The label can simultaneously serve as both an advertising logo and as a seal for enclosing the accessory products in the packaging. In addition, the label can be used to identify the products and/or affix coupons to the package. In one or more embodiments, the label can include a sticker-type of label that is placed over the opening in the packaging (shown in FIG. 3C).

The system 100 can also include a camera 110 that is used to monitor the position of the label that has been applied to the package. In the event that a label is identified as being improperly placed on a package, the package can be identified and the label can be removed and another label can be re-applied to meet the desired specification. An improper location can include a location that does not completely seal the opening in the bag. This improper positioning can lead to the accessory products, the spindle adapters and/or the spindle adapter packaging falling out of the packaging. Also, if the opening in the packaging is not completely sealed and improperly positioned, debris and other unwanted object may inadvertently enter the packaging. The system 100 can include a palletizer 112 to combine multiple packages to prepare them for transport and distribution.

Figure 2B:
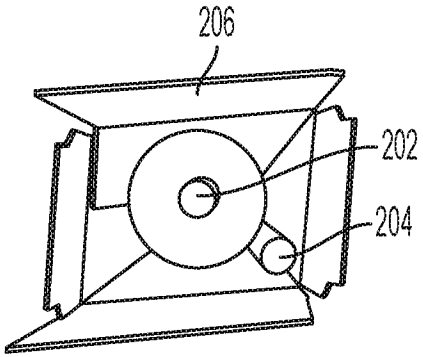
FIG. 2B depicts a view of the packaged spindle adapter accessory products according to one or more embodiments of the present invention.
Figure 2A:
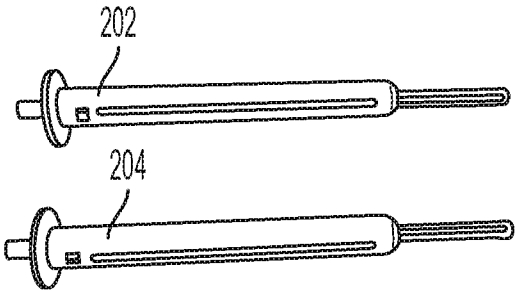
FIG. 2A depicts spindle adapter accessory products that are packaged in the process as shown in FIG. 1 according to one or more embodiments of the present invention.

FIG. 2A illustrates accessory products which include first and second spindle adapters 202, 204 that are packaged along with the coreless tissue products in accordance with one or more embodiments. The narrow aperture of the coreless tissue rolls is incompatible with the normal residential tissue holders. The spindle adapters 202, 204 are designed to allow the coreless tissue rolls to be adapted to fit commercial and/or residential tissue holders.

The first spindle adapter 202 and a second spindle adapter 204 are inserted into a spindle adapter package 206, such as that shown in FIG. 2B prior to being inserted into the packaging container. The spindle adapter package 206 can include a plurality of spindle adapters. The first spindle adapter 202 is arranged in a reverse direction of the second spindle adapter 204. This arrangement optimizes the available space within the spindle adapter package 206 and enables the size of the spindle adapter package 206 to be reduced to fit the cavity formed by the coreless tissue rolls. The spindle adapter package 206 can include a cardboard box-type material or other type of material that can be used to package multiple spindle adapters. It should be understood the spindle adapters 202, 204 can be arranged in different orientations and different numbers of spindle adapters 202, 204 can be packaged in each spindle adapter package 206. It should be understood that other accessory products can be packaged prior to being placed into the cavity.

Figure 3B:
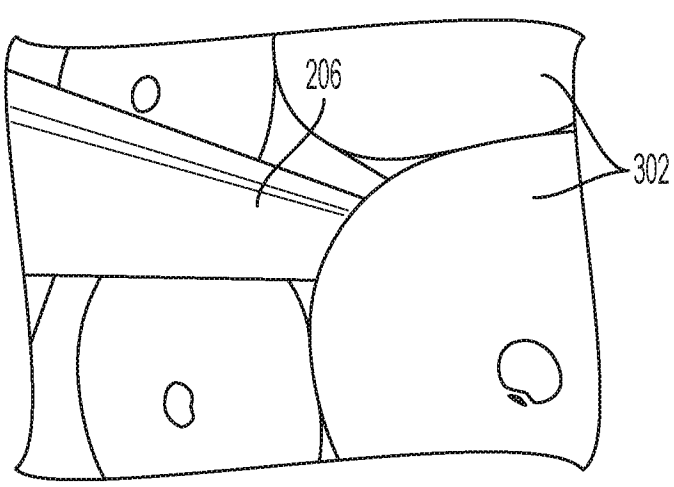
FIG. 3B depicts the spindle adapter accessory product package that is inserted into the package according to one or more embodiments of the present invention.
Figure 3A:
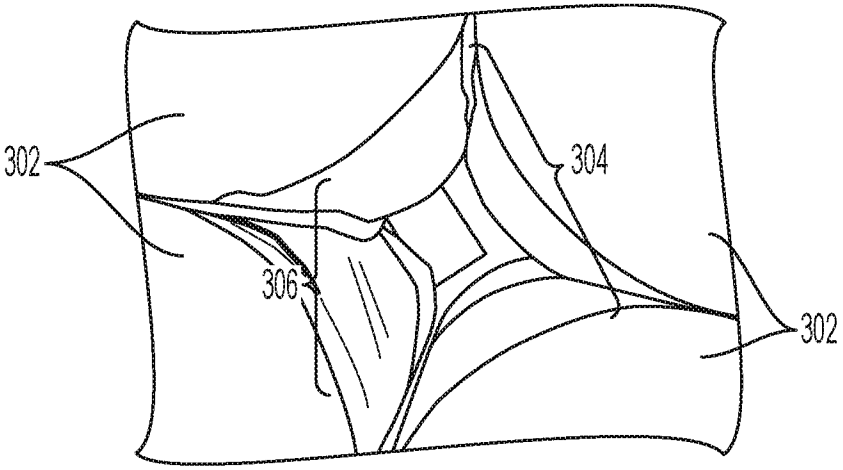
FIG. 3A depicts an opening in the package that is aligned with the coreless paper products according to one or more embodiments of the present invention.

FIG. 3A illustrates a top-down view of the packaged coreless rolls where a plurality of coreless tissue rolls 302 have been packaged in accordance with the system and method depicted in FIG. 1. The coreless tissue rolls 302 may be stacked or positioned in a variety of arrangements for packaging purposes. Once the coreless tissue rolls 302 have been packaged, one or more spindle adapters 202, 204 can be inserted into the cavity 304 formed by the multiple coreless tissue rolls 302. The cavity 304 provides a location to store the spindle adapters 202, 204 and the spindle adapter package 206 that houses one or more spindle adapters 202, 204. The cavity 304 that is formed from the packaged coreless tissue rolls 302 runs the length of the package.

Also, as shown in FIG. 3A the opening 306 formed in the container has been aligned with the cavity 304 formed by the multiple coreless tissue rolls 302. In one or more embodiments, the opening 306 can be formed after the coreless tissue rolls 302 have been packaged and sealed in the bag or wrap. This technique can alleviate the need to have the bagger align the pre-formed opening 306 in the bag with the cavity 304.

Figure 3C:
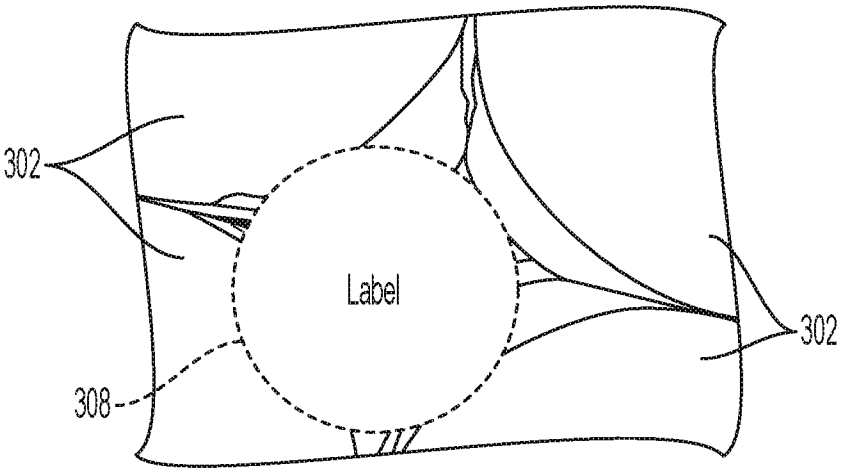
FIG. 3C depicts a label that is applied to the package after inserting the spindle adapter accessory product package according to one or more embodiments of the present invention.

FIG. 3B illustrates the spindle adapter package 206 that houses the one or more spindle adapters 202, 204 that was inserted into the container in accordance with one or more embodiments. FIG. 3C depicts a label 308 that is placed over the opening 306 to secure the packaged spindle adapters in the bag. In a non-limiting example, the label 308 can be a sticker or another type of adhesive-type label that can be affixed to the bag. The label 308 can simultaneously serve as both an advertising logo and as a seal for enclosing the spindle adapter package 206 in the packaging. In one or more embodiments, the label 308 can be applied by labeling equipment that can be pre-loaded with multiple labels.

Figure 4:
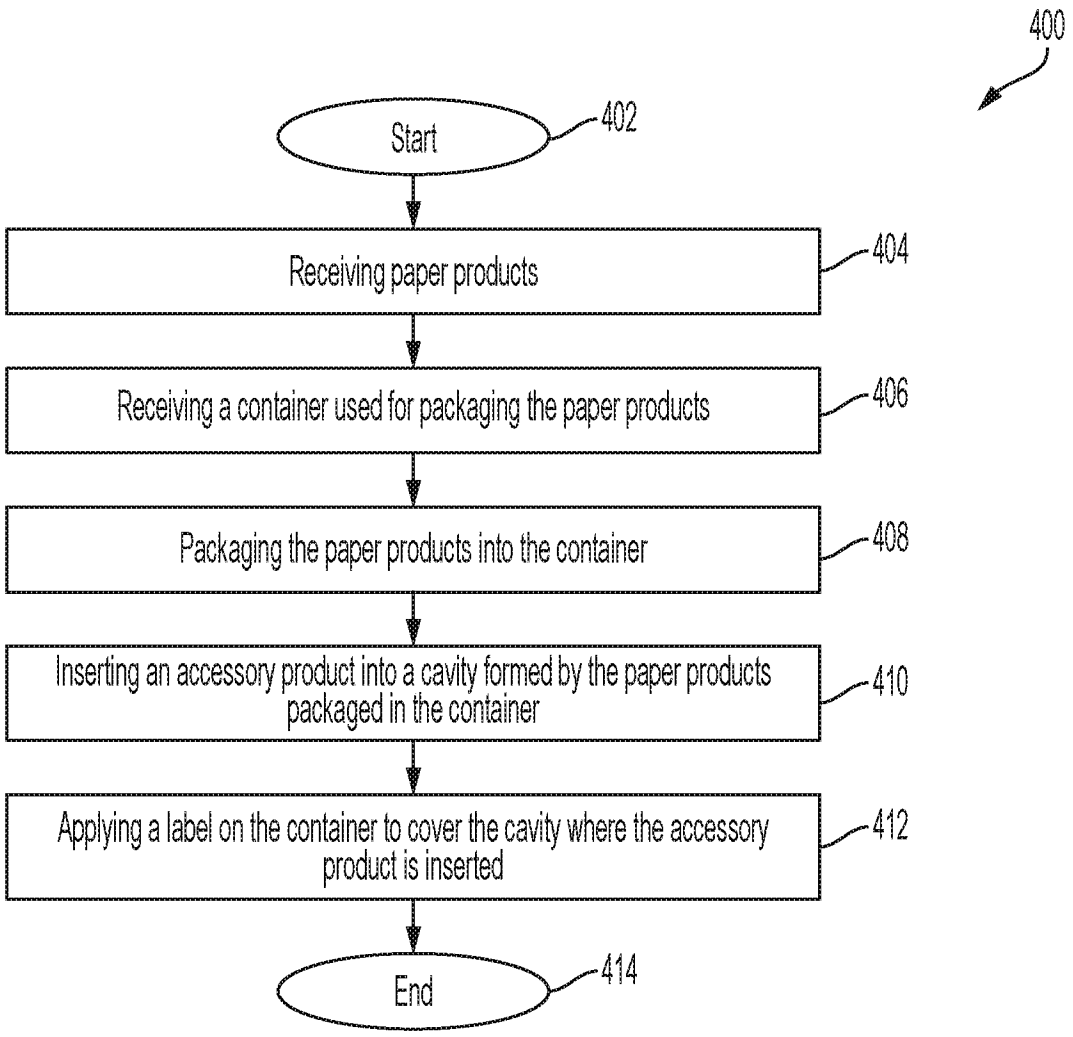
FIG. 4 is a flow diagram illustrating a method for packaging coreless roll products and accessory products in accordance with one or more embodiments of the present invention.

Referring now to FIG. 4, a flow diagram illustrating a method 400 for packaging coreless roll products and accessory products in accordance with an embodiment is shown. The method 400 can be performed using a system such as that shown in FIG. 1. The method 400 begins at block 402 and proceeds to block 404 which provides for receiving paper products. The paper products include coreless tissue rolls.

Block 406 receives a container used for packaging the paper products. In a non-limiting example, the container can include a bag or other type of wrap to bundle the paper products together for transport. In some embodiments, the bagger 102 can receive containers or bags that have been pre-punctured with an opening to allow for the insertion of the accessory products. In other embodiments, the bagger is configured to receive containers or bags the were not previously punctured. These containers or bags can be punctured to form an opening later in the packaging process.

Block 408 packages the paper products into the container. The bagger supplies the coreless tissue rolls to the containers which can be packaged in a variety of arrangements. The coreless tissue rolls can be arranged in different counts and different stackings. In the event a pre-punctured bag is provided to the bagger, the opening is aligned with the cavity that is formed by the plurality of coreless tissue rolls. The cavity can be formed by multiple adjacent coreless tissue rolls as shown in FIG. 3A.

Block 410 inserts an accessory product into a cavity formed by the paper products packaged in the container. In one or more embodiments, after the coreless tissue rolls are arranged and sealed in the bag, the accessory products such as the spindles can be manually inserted into the cavity of the container by an operator or other accessory product stuffing equipment. In some embodiments, multiple accessory products can be pre-packaged into a container such as a cardboard box prior to being inserted into the cavity formed by the paper products. This enables multiple spindle adapters to be inserted into the container at a time.

Block 412 applies a label on the container to cover the cavity where the accessory product is inserted. The label applicator is used to apply a sticker-type of label to the plastic bag. After the label is affixed to the container, the plurality of bundles of coreless tissue rolls can be provided to a palletizer to prepare for packaging and transport. The method 400 ends at block 414. It should be understood that additional steps or a different sequence of steps can be provided and is not limited by that shown in FIG. 4.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The flow diagrams depicted herein are just one example. There may be many variations to these diagrams or the steps (or operations) described therein without departing from the spirit of the invention. For instance, the steps may be performed in a differing order or steps may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the invention. The terminology used herein was chosen to best explain the principles of the embodiment, the practical application or technical improvement over technologies found in the marketplace, or to enable others of ordinary skill in the art to understand the embodiments disclosed herein.

What is claimed is:

1. A method for packaging paper products and accessory products, the method comprising:

receiving paper products;

receiving a container used for packaging the paper products;

packaging the paper products into the container;

aligning an opening in the container with a cavity formed by the paper products packaged in the container;

inserting an accessory product into the cavity formed by the paper products packaged in the container; and applying a label on the container to cover the opening aligned with the cavity where the accessory product is inserted.

2. The method of claim 1, wherein the paper products comprise coreless tissue rolls and the accessory product comprises a spindle adapter.

3. The method of claim 1, wherein the opening is formed in the container after packaging the paper products in the container, wherein the opening is formed in the container over the cavity to provide the aligning of the opening with the cavity formed by the paper products.

4. The method of claim 1, wherein the container comprises a bag that has been pre-punctured with the opening to receive the accessory product.

5. The method of claim 1, further comprising monitoring, using a camera, a position of the label on the container to determine placement on the package.

6. The method of claim 5, further comprising responsive to detecting an improper label position, re-applying the label on the container.

7. The method of claim 1, wherein the accessory product comprises a plurality of spindle adapters that are inserted into the container.

8. The method of claim 7, wherein the plurality of spindle adapters are packaged in a spindle adapter package.

9. The method of claim 8, wherein the plurality of spindle adapters are packaged in the spindle adapter package prior to inserting the spindle adapter package into the container.

10. A system for packaging products, the system comprising:

a bagger for receiving a container and paper products, wherein the bagger is configured to package the paper products into the container;

an inserter for inserting the accessory product into a cavity formed by the paper products in the container; and a labeler for applying a label on the container to cover an opening in the container that is aligned with the cavity where the accessory product is inserted.

11. The system of claim 10, wherein the paper products comprise coreless tissue rolls.

12. The system of claim 10, wherein the container comprises an opening in the container that is formed after packaging the paper products in the container, wherein the opening is formed in the container over the cavity formed by the paper products.

13. The system of claim 10, wherein the container comprises a bag that has been pre-punctured with an opening to receive the accessory product.

14. The system of claim 10, further comprising a camera to monitor a position of the label on the container to determine placement on the package.

15. The system of claim 14, further comprising responsive to detecting an improper label position, re-applying the label on the container.

16. The system of claim 10, wherein the accessory product comprises a plurality of spindle adapters that are inserted into the container.

17. The system of claim 16, wherein the plurality of spindle adapters are packaged in a spindle adapter package.

18. The system of claim 17, wherein the plurality of spindle adapters are packaged in the spindle adapter package prior to inserting the spindle adapter package into the container.

* * * * *